US006448960B1

(12) United States Patent
Shigeta

(10) Patent No.: US 6,448,960 B1
(45) Date of Patent: Sep. 10, 2002

(54) DRIVING METHOD OF PLASMA DISPLAY PANEL

(75) Inventor: Tetsuya Shigeta, Yamanashi (JP)

(73) Assignee: Pioneer Electronic Corporation, Tokyo (JP)

( * ) Notice: Subject to any disclaimer, the term of this patent is extended or adjusted under 35 U.S.C. 154(b) by 0 days.

(21) Appl. No.: 09/294,032

(22) Filed: Apr. 20, 1999

(30) Foreign Application Priority Data

Apr. 22, 1998 (JP) ..... 10-112245

(51) Int. Cl.[7] ..... G09G 5/00

(52) U.S. Cl. ..... 345/204; 345/60; 345/63; 345/69; 345/77; 345/89; 345/589; 345/596; 345/690; 345/691; 345/692

(58) Field of Search ..... 345/60, 63, 69, 345/204, 589, 596, 690, 691, 692, 77, 89

(56) References Cited

U.S. PATENT DOCUMENTS 5,757,343 A * 5/1998 Nagakubo ..... 345/63
6,097,357 A * 8/2000 Shinoda et al. ..... 345/63
6,127,991 A * 10/2000 Uehara et al. ..... 345/60
6,323,880 B1 * 11/2001 Yamada ..... 345/690
6,331,843 B1 * 12/2001 Kasahara et al. ..... 345/63
6,351,253 B2 * 2/2002 Kasahara et al. ..... 345/63

* cited by examiner

*Primary Examiner*—Richard Hjerpe
*Assistant Examiner*—Ali Zamani
(74) *Attorney, Agent, or Firm*—Sughrue Mion, PLLC

(57) ABSTRACT

A driving method of a plasma display panel which can perform an image display of a high quality in which a pseudo outline is suppressed while suppressing the number of bits of drive data. A display period of one field is divided into a plurality of subfields, and a light emitting state in a subfield of a relatively long light emitting period is also set by a pixel data bit to set a light emitting state of a subfield of a relatively short light emitting period in the subfields.

6 Claims, 13 Drawing Sheets

FIG. 3

| PIXEL DATA D | | | | | | COVERSION PIXEL DATA HD | | | | | | | |
|---|---|---|---|---|---|---|---|---|---|---|---|---|---|
| 0 | 1 | 2 | 3 | 4 | 5 | 0 | 1 | 2 | 3 | 4 | 5 | 6 | 7 |
| 0 | 0 | 0 | 0 | 0 | 0 | 0 | 0 | 0 | 0 | 0 | 0 | 0 | 0 |
| 0 | 0 | 0 | 0 | 0 | 1 | 1 | 0 | 0 | 0 | 0 | 0 | 0 | 0 |
| 0 | 0 | 0 | 0 | 1 | 0 | 0 | 1 | 0 | 0 | 0 | 0 | 0 | 0 |
| 0 | 0 | 0 | 0 | 1 | 1 | 1 | 1 | 0 | 0 | 0 | 0 | 0 | 0 |
| 0 | 0 | 0 | 1 | 0 | 0 | 0 | 0 | 1 | 0 | 0 | 0 | 0 | 0 |
| 0 | 0 | 0 | 1 | 0 | 1 | 1 | 0 | 1 | 0 | 0 | 0 | 0 | 0 |
| 0 | 0 | 0 | 1 | 1 | 0 | 0 | 1 | 1 | 0 | 0 | 0 | 0 | 0 |
| 0 | 0 | 0 | 1 | 1 | 1 | 1 | 1 | 1 | 0 | 0 | 0 | 0 | 0 |
| 0 | 0 | 1 | 0 | 0 | 0 | 0 | 0 | 0 | 1 | 0 | 0 | 0 | 0 |
| 0 | 0 | 1 | 0 | 0 | 1 | 1 | 0 | 0 | 1 | 0 | 0 | 0 | 0 |
| 0 | 0 | 1 | 0 | 1 | 0 | 0 | 1 | 0 | 1 | 0 | 0 | 0 | 0 |
| 0 | 0 | 1 | 0 | 1 | 1 | 1 | 1 | 0 | 1 | 0 | 0 | 0 | 0 |
| 0 | 0 | 1 | 1 | 0 | 0 | 0 | 0 | 1 | 1 | 0 | 0 | 0 | 0 |
| 0 | 0 | 1 | 1 | 0 | 1 | 1 | 0 | 1 | 1 | 0 | 0 | 0 | 0 |
| 0 | 0 | 1 | 1 | 1 | 0 | 0 | 1 | 1 | 1 | 0 | 0 | 0 | 0 |
| 0 | 0 | 1 | 1 | 1 | 1 | 1 | 1 | 1 | 1 | 0 | 0 | 0 | 0 |
| 0 | 1 | 0 | 0 | 0 | 0 | 0 | 0 | 0 | 1 | 1 | 0 | 0 | 0 |
| 0 | 1 | 0 | 0 | 0 | 1 | 1 | 0 | 0 | 1 | 1 | 0 | 0 | 0 |
| 0 | 1 | 0 | 0 | 1 | 0 | 0 | 1 | 0 | 1 | 1 | 0 | 0 | 0 |
| 0 | 1 | 0 | 0 | 1 | 1 | 1 | 1 | 0 | 1 | 1 | 0 | 0 | 0 |
| 0 | 1 | 0 | 1 | 0 | 0 | 0 | 0 | 1 | 1 | 1 | 0 | 0 | 0 |
| 0 | 1 | 0 | 1 | 0 | 1 | 1 | 0 | 1 | 1 | 1 | 0 | 0 | 0 |
| 0 | 1 | 0 | 1 | 1 | 0 | 0 | 1 | 1 | 1 | 1 | 0 | 0 | 0 |
| 0 | 1 | 0 | 1 | 1 | 1 | 1 | 1 | 1 | 1 | 1 | 0 | 0 | 0 |
| 0 | 1 | 1 | 0 | 0 | 0 | 0 | 0 | 0 | 1 | 1 | 1 | 0 | 0 |
| 0 | 1 | 1 | 0 | 0 | 1 | 1 | 0 | 0 | 1 | 1 | 1 | 0 | 0 |
| 0 | 1 | 1 | 0 | 1 | 0 | 0 | 1 | 0 | 1 | 1 | 1 | 0 | 0 |
| 0 | 1 | 1 | 0 | 1 | 1 | 1 | 1 | 0 | 1 | 1 | 1 | 0 | 0 |
| 0 | 1 | 1 | 1 | 0 | 0 | 0 | 0 | 1 | 1 | 1 | 1 | 0 | 0 |
| 0 | 1 | 1 | 1 | 0 | 1 | 1 | 0 | 1 | 1 | 1 | 1 | 0 | 0 |
| 0 | 1 | 1 | 1 | 1 | 0 | 0 | 1 | 1 | 1 | 1 | 1 | 0 | 0 |
| 0 | 1 | 1 | 1 | 1 | 1 | 1 | 1 | 1 | 1 | 1 | 1 | 0 | 0 |

FIG. 4

| PIXEL DATA D | | | | | | COVERSION PIXEL DATA HD | | | | | | | |
|---|---|---|---|---|---|---|---|---|---|---|---|---|---|
| 0 | 1 | 2 | 3 | 4 | 5 | 0 | 1 | 2 | 3 | 4 | 5 | 6 | 7 |
| 1 | 0 | 0 | 0 | 0 | 0 | 0 | 0 | 0 | 1 | 1 | 1 | 1 | 0 |
| 1 | 0 | 0 | 0 | 0 | 1 | 1 | 0 | 0 | 1 | 1 | 1 | 1 | 0 |
| 1 | 0 | 0 | 0 | 1 | 0 | 0 | 1 | 0 | 1 | 1 | 1 | 1 | 0 |
| 1 | 0 | 0 | 0 | 1 | 1 | 1 | 1 | 0 | 1 | 1 | 1 | 1 | 0 |
| 1 | 0 | 0 | 1 | 0 | 0 | 0 | 0 | 1 | 1 | 1 | 1 | 1 | 0 |
| 1 | 0 | 0 | 1 | 0 | 1 | 1 | 0 | 1 | 1 | 1 | 1 | 1 | 0 |
| 1 | 0 | 0 | 1 | 1 | 0 | 0 | 1 | 1 | 1 | 1 | 1 | 1 | 0 |
| 1 | 0 | 0 | 1 | 1 | 1 | 1 | 1 | 1 | 1 | 1 | 1 | 1 | 0 |
| 1 | 0 | 1 | 0 | 0 | 0 | 0 | 0 | 0 | 1 | 1 | 1 | 1 | 1 |
| 1 | 0 | 1 | 0 | 0 | 1 | 0 | 0 | 0 | 1 | 1 | 1 | 1 | 1 |
| 1 | 0 | 1 | 0 | 1 | 0 | 0 | 1 | 0 | 1 | 1 | 1 | 1 | 1 |
| 1 | 0 | 1 | 0 | 1 | 1 | 0 | 1 | 0 | 1 | 1 | 1 | 1 | 1 |
| 1 | 0 | 1 | 1 | 0 | 0 | 0 | 0 | 1 | 1 | 1 | 1 | 1 | 1 |
| 1 | 0 | 1 | 1 | 0 | 1 | 0 | 0 | 1 | 1 | 1 | 1 | 1 | 1 |
| 1 | 0 | 1 | 1 | 1 | 0 | 0 | 1 | 1 | 1 | 1 | 1 | 1 | 1 |
| 1 | 0 | 1 | 1 | 1 | 1 | 0 | 1 | 1 | 1 | 1 | 1 | 1 | 1 |
| 1 | 1 | 0 | 0 | 0 | 0 | 1 | 0 | 0 | 1 | 1 | 1 | 1 | 1 |
| 1 | 1 | 0 | 0 | 0 | 1 | 1 | 0 | 0 | 1 | 1 | 1 | 1 | 1 |
| 1 | 1 | 0 | 0 | 1 | 0 | 1 | 0 | 0 | 1 | 1 | 1 | 1 | 1 |
| 1 | 1 | 0 | 0 | 1 | 1 | 1 | 0 | 0 | 1 | 1 | 1 | 1 | 1 |
| 1 | 1 | 0 | 1 | 0 | 0 | 1 | 0 | 1 | 1 | 1 | 1 | 1 | 1 |
| 1 | 1 | 0 | 1 | 0 | 1 | 1 | 0 | 1 | 1 | 1 | 1 | 1 | 1 |
| 1 | 1 | 0 | 1 | 1 | 0 | 1 | 0 | 1 | 1 | 1 | 1 | 1 | 1 |
| 1 | 1 | 0 | 1 | 1 | 1 | 1 | 0 | 1 | 1 | 1 | 1 | 1 | 1 |
| 1 | 1 | 1 | 0 | 0 | 0 | 1 | 1 | 0 | 1 | 1 | 1 | 1 | 1 |
| 1 | 1 | 1 | 0 | 0 | 1 | 1 | 1 | 0 | 1 | 1 | 1 | 1 | 1 |
| 1 | 1 | 1 | 0 | 1 | 0 | 1 | 1 | 0 | 1 | 1 | 1 | 1 | 1 |
| 1 | 1 | 1 | 0 | 1 | 1 | 1 | 1 | 0 | 1 | 1 | 1 | 1 | 1 |
| 1 | 1 | 1 | 1 | 0 | 0 | 1 | 1 | 1 | 1 | 1 | 1 | 1 | 1 |
| 1 | 1 | 1 | 1 | 0 | 1 | 1 | 1 | 1 | 1 | 1 | 1 | 1 | 1 |
| 1 | 1 | 1 | 1 | 1 | 0 | 1 | 1 | 1 | 1 | 1 | 1 | 1 | 1 |
| 1 | 1 | 1 | 1 | 1 | 1 | 1 | 1 | 1 | 1 | 1 | 1 | 1 | 1 |

FIG. 6

| PIXEL DATA D | COVERSION PIXEL DATA HD READ OUT FROM MEMORY 4 | | | | | | | | | |
|---|---|---|---|---|---|---|---|---|---|---|
| | 0TH BIT | 1ST BIT | 2ND BIT | 3RD BIT | 4TH BIT | 5TH BIT | 6TH BIT | 7TH BIT | 0TH BIT | 1ST BIT |
| 0 0 0 0 0 0 | 0 | 0 | 0 | 0 | 0 | 0 | 0 | 0 | 0 | 0 |
| 0 0 0 0 0 1 | 1 | 0 | 0 | 0 | 0 | 0 | 0 | 0 | 1 | 0 |
| 0 0 0 0 1 0 | 0 | 1 | 0 | 0 | 0 | 0 | 0 | 0 | 0 | 1 |
| 0 0 0 0 1 1 | 1 | 1 | 0 | 0 | 0 | 0 | 0 | 0 | 1 | 1 |
| 0 0 0 1 0 0 | 0 | 0 | 1 | 0 | 0 | 0 | 0 | 0 | 0 | 0 |
| 0 0 0 1 0 1 | 1 | 0 | 1 | 0 | 0 | 0 | 0 | 0 | 1 | 0 |
| 0 0 0 1 1 0 | 0 | 1 | 1 | 0 | 0 | 0 | 0 | 0 | 0 | 1 |
| 0 0 0 1 1 1 | 1 | 1 | 1 | 0 | 0 | 0 | 0 | 0 | 1 | 1 |
| 0 0 1 0 0 0 | 0 | 0 | 0 | 1 | 0 | 0 | 0 | 0 | 0 | 0 |
| 0 0 1 0 0 1 | 1 | 0 | 0 | 1 | 0 | 0 | 0 | 0 | 1 | 0 |
| 0 0 1 0 1 0 | 0 | 1 | 0 | 1 | 0 | 0 | 0 | 0 | 0 | 1 |
| 0 0 1 0 1 1 | 1 | 1 | 0 | 1 | 0 | 0 | 0 | 0 | 1 | 1 |
| 0 0 1 1 0 0 | 0 | 0 | 1 | 1 | 0 | 0 | 0 | 0 | 0 | 0 |
| 0 0 1 1 0 1 | 1 | 0 | 1 | 1 | 0 | 0 | 0 | 0 | 1 | 0 |
| 0 0 1 1 1 0 | 0 | 1 | 1 | 1 | 0 | 0 | 0 | 0 | 0 | 1 |
| 0 0 1 1 1 1 | 1 | 1 | 1 | 1 | 0 | 0 | 0 | 0 | 1 | 1 |
| 0 1 0 0 0 0 | 0 | 0 | 0 | 1 | 1 | 0 | 0 | 0 | 0 | 0 |
| 0 1 0 0 0 1 | 1 | 0 | 0 | 1 | 1 | 0 | 0 | 0 | 1 | 0 |
| 0 1 0 0 1 0 | 0 | 1 | 0 | 1 | 1 | 0 | 0 | 0 | 0 | 1 |
| 0 1 0 0 1 1 | 1 | 1 | 0 | 1 | 1 | 0 | 0 | 0 | 1 | 1 |
| 0 1 0 1 0 0 | 0 | 0 | 1 | 1 | 1 | 0 | 0 | 0 | 0 | 0 |
| 0 1 0 1 0 1 | 1 | 0 | 1 | 1 | 1 | 0 | 0 | 0 | 1 | 0 |
| 0 1 0 1 1 0 | 0 | 1 | 1 | 1 | 1 | 0 | 0 | 0 | 0 | 1 |
| 0 1 0 1 1 1 | 1 | 1 | 1 | 1 | 1 | 0 | 0 | 0 | 1 | 1 |
| 0 1 1 0 0 0 | 0 | 0 | 0 | 1 | 1 | 1 | 0 | 0 | 0 | 0 |
| 0 1 1 0 0 1 | 1 | 0 | 0 | 1 | 1 | 1 | 0 | 0 | 1 | 0 |
| 0 1 1 0 1 0 | 0 | 1 | 0 | 1 | 1 | 1 | 0 | 0 | 0 | 1 |
| 0 1 1 0 1 1 | 1 | 1 | 0 | 1 | 1 | 1 | 0 | 0 | 1 | 1 |
| 0 1 1 1 0 0 | 0 | 0 | 1 | 1 | 1 | 1 | 0 | 0 | 0 | 0 |
| 0 1 1 1 0 1 | 1 | 0 | 1 | 1 | 1 | 1 | 0 | 0 | 1 | 0 |
| 0 1 1 1 1 0 | 0 | 1 | 1 | 1 | 1 | 1 | 0 | 0 | 0 | 1 |
| 0 1 1 1 1 1 | 1 | 1 | 1 | 1 | 1 | 1 | 0 | 0 | 1 | 1 |
| SUBFIELD | SF1 | SF2 | SF3 | SF4a | SF4b | SF4c | SF4d | SF4e | SF4f | SF4g |

FIG.7

| PIXEL DATA D | COVERSION PIXEL DATA HD READ OUT FROM MEMORY 4 | | | | | | | | | |
|---|---|---|---|---|---|---|---|---|---|---|
| | 0TH BIT | 1ST BIT | 2ND BIT | 3RD BIT | 4TH BIT | 5TH BIT | 6TH BIT | 7TH BIT | 0TH BIT | 1ST BIT |
| 1 0 0 0 0 0 | 0 | 0 | 0 | 1 | 1 | 1 | 1 | 0 | 0 | 0 |
| 1 0 0 0 0 1 | 1 | 0 | 0 | 1 | 1 | 1 | 1 | 0 | 1 | 0 |
| 1 0 0 0 1 0 | 0 | 1 | 0 | 1 | 1 | 1 | 1 | 0 | 0 | 1 |
| 1 0 0 0 1 1 | 1 | 1 | 0 | 1 | 1 | 1 | 1 | 0 | 1 | 1 |
| 1 0 0 1 0 0 | 0 | 0 | 1 | 1 | 1 | 1 | 1 | 0 | 0 | 0 |
| 1 0 0 1 0 1 | 1 | 0 | 1 | 1 | 1 | 1 | 1 | 0 | 1 | 0 |
| 1 0 0 1 1 0 | 0 | 1 | 1 | 1 | 1 | 1 | 1 | 0 | 0 | 1 |
| 1 0 0 1 1 1 | 1 | 1 | 1 | 1 | 1 | 1 | 1 | 0 | 1 | 1 |
| 1 0 1 0 0 0 | 0 | 0 | 0 | 1 | 1 | 1 | 1 | 1 | 0 | 0 |
| 1 0 1 0 0 1 | 0 | 0 | 0 | 1 | 1 | 1 | 1 | 1 | 0 | 0 |
| 1 0 1 0 1 0 | 0 | 1 | 0 | 1 | 1 | 1 | 1 | 1 | 0 | 1 |
| 1 0 1 0 1 1 | 0 | 1 | 0 | 1 | 1 | 1 | 1 | 1 | 0 | 1 |
| 1 0 1 1 0 0 | 0 | 0 | 1 | 1 | 1 | 1 | 1 | 1 | 0 | 0 |
| 1 0 1 1 0 1 | 0 | 0 | 1 | 1 | 1 | 1 | 1 | 1 | 0 | 0 |
| 1 0 1 1 1 0 | 0 | 1 | 1 | 1 | 1 | 1 | 1 | 1 | 0 | 1 |
| 1 0 1 1 1 1 | 0 | 1 | 1 | 1 | 1 | 1 | 1 | 1 | 0 | 1 |
| 1 1 0 0 0 0 | 1 | 0 | 0 | 1 | 1 | 1 | 1 | 1 | 1 | 0 |
| 1 1 0 0 0 1 | 1 | 0 | 0 | 1 | 1 | 1 | 1 | 1 | 1 | 0 |
| 1 1 0 0 1 0 | 1 | 0 | 0 | 1 | 1 | 1 | 1 | 1 | 1 | 0 |
| 1 1 0 0 1 1 | 1 | 0 | 0 | 1 | 1 | 1 | 1 | 1 | 1 | 0 |
| 1 1 0 1 0 0 | 1 | 0 | 1 | 1 | 1 | 1 | 1 | 1 | 1 | 0 |
| 1 1 0 1 0 1 | 1 | 0 | 1 | 1 | 1 | 1 | 1 | 1 | 1 | 0 |
| 1 1 0 1 1 0 | 1 | 0 | 1 | 1 | 1 | 1 | 1 | 1 | 1 | 0 |
| 1 1 0 1 1 1 | 1 | 0 | 1 | 1 | 1 | 1 | 1 | 1 | 1 | 0 |
| 1 1 1 0 0 0 | 1 | 1 | 0 | 1 | 1 | 1 | 1 | 1 | 1 | 1 |
| 1 1 1 0 0 1 | 1 | 1 | 0 | 1 | 1 | 1 | 1 | 1 | 1 | 1 |
| 1 1 1 0 1 0 | 1 | 1 | 0 | 1 | 1 | 1 | 1 | 1 | 1 | 1 |
| 1 1 1 0 1 1 | 1 | 1 | 0 | 1 | 1 | 1 | 1 | 1 | 1 | 1 |
| 1 1 1 1 0 0 | 1 | 1 | 1 | 1 | 1 | 1 | 1 | 1 | 1 | 1 |
| 1 1 1 1 0 1 | 1 | 1 | 1 | 1 | 1 | 1 | 1 | 1 | 1 | 1 |
| 1 1 1 1 1 0 | 1 | 1 | 1 | 1 | 1 | 1 | 1 | 1 | 1 | 1 |
| 1 1 1 1 1 1 | 1 | 1 | 1 | 1 | 1 | 1 | 1 | 1 | 1 | 1 |
| SUBFIELD | SF1 | SF2 | SF3 | SF4a | SF4b | SF4c | SF4d | SF4e | SF4f | SF4g |

FIG. 9

LIGHT EMITTING PERIOD RATIO

DISPLAY LUMINANCE

| PIXEL DATA D \ SF | SF1 | SF2 | SF3 | SF4a | SF4b | SF4c | SF4d | SF4e | SF4f | SF4g | |
|---|---|---|---|---|---|---|---|---|---|---|---|
| | 1 | 2 | 4 | 8 | 8 | 8 | 8 | 8 | 7 | 6 | |
| 0 0 0 0 0 0 | | | | | | | | | | | 0 |
| 0 0 0 0 0 1 | ○ | | | | | | | | | | 1 |
| 0 0 0 0 1 0 | | ○ | | | | | | | | | 2 |
| 0 0 0 0 1 1 | ○ | ○ | | | | | | | | | 3 |
| 0 0 0 1 0 0 | | | ○ | | | | | | | | 4 |
| 0 0 0 1 0 1 | ○ | | ○ | | | | | | | | 5 |
| 0 0 0 1 1 0 | | ○ | ○ | | | | | | | | 6 |
| 0 0 0 1 1 1 | ○ | ○ | ○ | | | | | | | | 7 |
| 0 0 1 0 0 0 | | | | ○ | | | | | | | 8 |
| 0 0 1 0 0 1 | ○ | | | ○ | | | | | | | 9 |
| 0 0 1 0 1 0 | | ○ | | ○ | | | | | | | 10 |
| 0 0 1 0 1 1 | ○ | ○ | | ○ | | | | | | | 11 |
| 0 0 1 1 0 0 | | | ○ | ○ | | | | | | | 12 |
| 0 0 1 1 0 1 | ○ | | ○ | ○ | | | | | | | 13 |
| 0 0 1 1 1 0 | | ○ | ○ | ○ | | | | | | | 14 |
| 0 0 1 1 1 1 | ○ | ○ | ○ | ○ | | | | | | | 15 |
| 0 1 0 0 0 0 | | | | ○ | ○ | | | | | | 16 |
| 0 1 0 0 0 1 | ○ | | | ○ | ○ | | | | | | 17 |
| 0 1 0 0 1 0 | | ○ | | ○ | ○ | | | | | | 18 |
| 0 1 0 0 1 1 | ○ | ○ | | ○ | ○ | | | | | | 19 |
| 0 1 0 1 0 0 | | | ○ | ○ | ○ | | | | | | 20 |
| 0 1 0 1 0 1 | ○ | | ○ | ○ | ○ | | | | | | 21 |
| 0 1 0 1 1 0 | | ○ | ○ | ○ | ○ | | | | | | 22 |
| 0 1 0 1 1 1 | ○ | ○ | ○ | ○ | ○ | | | | | | 23 |
| 0 1 1 0 0 0 | | | | ○ | ○ | ○ | | | | | 24 |
| 0 1 1 0 0 1 | ○ | | | ○ | ○ | ○ | | | | | 25 |
| 0 1 1 0 1 0 | | ○ | | ○ | ○ | ○ | | | | | 26 |
| 0 1 1 0 1 1 | ○ | ○ | | ○ | ○ | ○ | | | | | 27 |
| 0 1 1 1 0 0 | | | ○ | ○ | ○ | ○ | | | | | 28 |
| 0 1 1 1 0 1 | ○ | | ○ | ○ | ○ | ○ | | | | | 29 |
| 0 1 1 1 1 0 | | ○ | ○ | ○ | ○ | ○ | | | | | 30 |
| 0 1 1 1 1 1 | ○ | ○ | ○ | ○ | ○ | ○ | | | | | 31 |

FIG.10

LIGHT EMITTING PERIOD RATIO

DISPLAY LUMINANCE

| PIXEL DATA D \ SF | SF1 | SF2 | SF3 | SF4a | SF4b | SF4c | SF4d | SF4e | SF4f | SF4g | |
|---|---|---|---|---|---|---|---|---|---|---|---|
| | 1 | 2 | 4 | 8 | 8 | 8 | 8 | 8 | 7 | 6 | |
| 1 0 0 0 0 0 | | | | ○ | ○ | ○ | ○ | | | | 32 |
| 1 0 0 0 0 1 | ○ | | | ○ | ○ | ○ | ○ | | | | 33 |
| 1 0 0 0 1 0 | | ○ | | ○ | ○ | ○ | ○ | | | | 34 |
| 1 0 0 0 1 1 | ○ | ○ | | ○ | ○ | ○ | ○ | | | | 35 |
| 1 0 0 1 0 0 | | | ○ | ○ | ○ | ○ | ○ | | | | 36 |
| 1 0 0 1 0 1 | ○ | | ○ | ○ | ○ | ○ | ○ | | | | 37 |
| 1 0 0 1 1 0 | | ○ | ○ | ○ | ○ | ○ | ○ | | | | 38 |
| 1 0 0 1 1 1 | ○ | ○ | ○ | ○ | ○ | ○ | ○ | | | | 39 |
| 1 0 1 0 0 0 | | | | ○ | ○ | ○ | ○ | ○ | | | 40 |
| 1 0 1 0 0 1 | | | | ○ | ○ | ○ | ○ | ○ | | | 40 |
| 1 0 1 0 1 0 | | ○ | | ○ | ○ | ○ | ○ | ○ | | | 42 |
| 1 0 1 0 1 1 | | ○ | | ○ | ○ | ○ | ○ | ○ | | | 42 |
| 1 0 1 1 0 0 | | | ○ | ○ | ○ | ○ | ○ | ○ | | | 44 |
| 1 0 1 1 0 1 | | | ○ | ○ | ○ | ○ | ○ | ○ | | | 44 |
| 1 0 1 1 1 0 | | ○ | ○ | ○ | ○ | ○ | ○ | ○ | | | 46 |
| 1 0 1 1 1 1 | | ○ | ○ | ○ | ○ | ○ | ○ | ○ | | | 46 |
| 1 1 0 0 0 0 | ○ | | | ○ | ○ | ○ | ○ | ○ | ○ | | 48 |
| 1 1 0 0 0 1 | ○ | | | ○ | ○ | ○ | ○ | ○ | ○ | | 48 |
| 1 1 0 0 1 0 | ○ | | | ○ | ○ | ○ | ○ | ○ | ○ | | 48 |
| 1 1 0 0 1 1 | ○ | | | ○ | ○ | ○ | ○ | ○ | ○ | | 48 |
| 1 1 0 1 0 0 | ○ | | ○ | ○ | ○ | ○ | ○ | ○ | ○ | | 52 |
| 1 1 0 1 0 1 | ○ | | ○ | ○ | ○ | ○ | ○ | ○ | ○ | | 52 |
| 1 1 0 1 1 0 | ○ | | ○ | ○ | ○ | ○ | ○ | ○ | ○ | | 52 |
| 1 1 0 1 1 1 | ○ | | ○ | ○ | ○ | ○ | ○ | ○ | ○ | | 52 |
| 1 1 1 0 0 0 | ○ | ○ | | ○ | ○ | ○ | ○ | ○ | ○ | ○ | 56 |
| 1 1 1 0 0 1 | ○ | ○ | | ○ | ○ | ○ | ○ | ○ | ○ | ○ | 56 |
| 1 1 1 0 1 0 | ○ | ○ | | ○ | ○ | ○ | ○ | ○ | ○ | ○ | 56 |
| 1 1 1 0 1 1 | ○ | ○ | | ○ | ○ | ○ | ○ | ○ | ○ | ○ | 56 |
| 1 1 1 1 0 0 | ○ | ○ | ○ | ○ | ○ | ○ | ○ | ○ | ○ | ○ | 60 |
| 1 1 1 1 0 1 | ○ | ○ | ○ | ○ | ○ | ○ | ○ | ○ | ○ | ○ | 60 |
| 1 1 1 1 1 0 | ○ | ○ | ○ | ○ | ○ | ○ | ○ | ○ | ○ | ○ | 60 |
| 1 1 1 1 1 1 | ○ | ○ | ○ | ○ | ○ | ○ | ○ | ○ | ○ | ○ | 60 |

FIG.12

LIGHT EMITTING PERIOD RATIO

CONVERSION PIXEL DATA HD READ OUT FROM MEMORY 4

DISPLAY LUMINANCE

| | 0TH BIT | 1ST BIT | 2ND BIT | 3RD BIT | 4TH BIT | 5TH BIT | 6TH BIT | 7TH BIT | 0TH BIT | 1ST BIT | 2ND BIT | 3RD BIT | |
|---|---|---|---|---|---|---|---|---|---|---|---|---|---|
| SF / PIXEL DATA (DECIMAL) | SF1 | SF2 | SF3 | SF4 | SF5 | SF6 a | SF6 b | SF6 c | SF6 d | SF6 e | SF6 f | SF6 g | |
| | 1 | 2 | 4 | 8 | 16 | 32 | 32 | 32 | 31 | 30 | 28 | 24 | |
| 0 | 0 | 0 | 0 | 0 | 0 | 0 | 0 | 0 | 0 | 0 | 0 | 0 | 0 |
| ~ | | ~ | | | ⋮ | ⋮ | ⋮ | ⋮ | | ~ | | | ~ |
| 15 | 1 | 1 | 1 | 1 | 0 | 0 | 0 | 0 | 1 | 1 | 1 | 1 | 15 |
| ~ | | | ~ | | | ⋮ | ⋮ | ⋮ | | ~ | | | ~ |
| 31 | 1 | 1 | 1 | 1 | 1 | 0 | 0 | 0 | 1 | 1 | 1 | 1 | 31 |
| ~ | | | | ~ | | | | ⋮ | | ~ | | | ~ |
| 95 | 1 | 1 | 1 | 1 | 1 | 1 | 1 | 0 | 1 | 1 | 1 | 1 | 95 |
| 96 | 0 | 0 | 0 | 0 | 0 | 1 | 1 | 1 | 0 | 0 | 0 | 0 | 96 |
| 97 | 0 | 0 | 0 | 0 | 0 | 1 | 1 | 1 | 0 | 0 | 0 | 0 | 96 |
| 98 | 0 | 1 | 0 | 0 | 0 | 1 | 1 | 1 | 0 | 1 | 0 | 0 | 98 |
| 99 | 0 | 1 | 0 | 0 | 0 | 1 | 1 | 1 | 0 | 1 | 0 | 0 | 98 |
| ~ | | | ~ | | | ⋮ | ⋮ | ⋮ | | ~ | | | ~ |
| 116 | 0 | 0 | 1 | 0 | 1 | 1 | 1 | 1 | 0 | 0 | 1 | 0 | 116 |
| 117 | 0 | 0 | 1 | 0 | 1 | 1 | 1 | 1 | 0 | 0 | 1 | 0 | 116 |
| ~ | | | ~ | | | ⋮ | ⋮ | ⋮ | | ~ | | | ~ |
| 126 | 0 | 1 | 1 | 1 | 1 | 1 | 1 | 1 | 0 | 1 | 1 | 1 | 126 |
| 127 | 0 | 1 | 1 | 1 | 1 | 1 | 1 | 1 | 0 | 1 | 1 | 1 | 126 |

FIG.13

LIGHT EMITTING PERIOD RATIO

CONVERSION PIXEL DATA HD READ OUT FROM MEMORY 4

DISPLAY LUMINANCE

| | 0TH BIT | 1ST BIT | 2ND BIT | 3RD BIT | 4TH BIT | 5TH BIT | 6TH BIT | 7TH BIT | 0TH BIT | 1ST BIT | 2ND BIT | 3RD BIT | |
|---|---|---|---|---|---|---|---|---|---|---|---|---|---|
| SF / PIXEL DATA (DECIMAL) | SF1 | SF2 | SF3 | SF4 | SF5 | SF6 a | SF6 b | SF6 c | SF6 d | SF6 e | SF6 f | SF6 g | |
| | 1 | 2 | 4 | 8 | 16 | 32 | 32 | 32 | 31 | 30 | 28 | 24 | |
| 128∼131 | 1 | 0 | 0 | 0 | 0 | 1 | 1 | 1 | 1 | 0 | 0 | 0 | 128 |
| 132∼135 | 1 | 0 | 1 | 0 | 0 | 1 | 1 | 1 | 1 | 0 | 1 | 0 | 132 |
| 136∼139 | 1 | 0 | 0 | 1 | 0 | 1 | 1 | 1 | 1 | 0 | 0 | 1 | 136 |
| 140∼143 | 1 | 0 | 1 | 1 | 0 | 1 | 1 | 1 | 1 | 0 | 1 | 1 | 140 |
| ∼ | | ∼ | | | ⋮ | ⋮ | ⋮ | ⋮ | | ∼ | | | ∼ |
| 156∼159 | 1 | 0 | 1 | 1 | 1 | 1 | 1 | 1 | 1 | 0 | 1 | 1 | 156 |
| 160∼167 | 1 | 1 | 0 | 0 | 0 | 1 | 1 | 1 | 1 | 1 | 0 | 0 | 160 |
| 168∼175 | 1 | 1 | 0 | 1 | 0 | 1 | 1 | 1 | 1 | 1 | 0 | 1 | 168 |
| 176∼179 | 1 | 1 | 0 | 0 | 1 | 1 | 1 | 1 | 1 | 1 | 0 | 0 | 176 |
| 180∼183 | 1 | 1 | 0 | 1 | 1 | 1 | 1 | 1 | 1 | 1 | 0 | 1 | 180 |
| 184∼191 | 1 | 1 | 0 | 1 | 1 | 1 | 1 | 1 | 1 | 1 | 0 | 1 | 184 |
| 192∼207 | 1 | 1 | 1 | 0 | 0 | 1 | 1 | 1 | 1 | 1 | 1 | 0 | 192 |
| 208∼223 | 1 | 1 | 1 | 0 | 1 | 1 | 1 | 1 | 1 | 1 | 1 | 0 | 208 |
| 224∼239 | 1 | 1 | 1 | 1 | 0 | 1 | 1 | 1 | 1 | 1 | 1 | 1 | 224 |
| 240∼255 | 1 | 1 | 1 | 1 | 1 | 1 | 1 | 1 | 1 | 1 | 1 | 1 | 240 |

DRIVING METHOD OF PLASMA DISPLAY PANEL

BACKGROUND OF THE INVENTION

1. Field of the Invention

The invention relates to a driving method of a plasma display panel (hereinafter, simply referred to as a "PDP") of a matrix display type.

2. Description of Related Art

As one of the display panels of the matrix display type, a PDP of AC (alternating current discharge) type is known.

The AC type PDP has a plurality of column electrodes (address electrodes) and a plurality of row electrode pairs which are arranged so as to perpendicularly intersect the column electrodes and in which one scanning line is formed by one pair. Each of the row electrode pairs and the column electrodes are covered by a dielectric layer against a discharge space and a discharge cell corresponding to one pixel is formed at an intersection point of the row electrode pair and the column electrode.

As a method of allowing the PDP to embody a halftone display, there is a so called a subfield method wherein one field period is divided into N subfields each emits the light only for a time corresponding to a weight of each bit digit of pixel data of N bits and the data is displayed. The method is disclosed, for example, in Japanese Patent Kokai No. 4-195087.

FIG. 1 is a diagram showing a format of the light-emission driving in one field period according to the subfield method.

In the example shown in FIG. 1, in which it is presumed that the pixel data being supplied consists of six bits, the period of time of one field is divided into six subfields SF1, SF2, . . . , and SF6, to perform the light-emission driving. By executing the light emission through the six subfields once, an expression of 64 gradations can be performed for an image of one field.

Each subfield is constructed by an all-resetting step Rc, a pixel data writing step Wc, and a sustain light emitting step Ic. In the all-resetting step Rc, by discharge-exciting (reset discharge) all of the discharge cells of the PDP in a lump, wall charges are uniformly formed in all of the discharge cells. In the next pixel data writing step Wc, a selective erasure discharge according to the pixel data is excited every discharge cell. The wall charges in the discharge cell in which the erasure discharge has been performed are extinguished and this discharge cell becomes a "non-light emission cell". The discharge cell in which the erasure discharge is not performed becomes a "light emission cell" because the wall charges remain there. In the sustain light emitting step Ic, a discharge light emitting state is continued only for the light emission cell only for a time corresponding to the weight of each subfield. In each of the subfields SF1 to SF6, consequently, a sustain light emission is sequentially performed with weights of light emitting period ratios of 1:2:4:8:16:32.

For example, if an image such that a flat object moves is displayed by the driving method, however, there is a problem such that a fringe-like pseudo outline like a video image as if the gradations were lost is observed at points near the positions where the luminance gradation level transverses the boundary of n-th power of 2, such as "32" or "16".

The above problem occurs because in the case where the luminance gradation level is "32", the light emission is performed only in the subfield SF6 during the 1-field period as shown in FIG. 1 and, when the luminance gradation level is equal to "31", the light emission is not performed in the subfield SF6, and the light emission is performed in the subfields SF1 to SF5. That is, for a period of time during which the discharge cell which should perform the light emission at the luminance gradation level "32" is lit on, the discharge cell which should perform the light emission at the luminance gradation level "31" is certainly in a light-off state, so that the fringe-like outline that is not concerned with the image is confirmed on the boundary of the discharge cells.

To suppress the pseudo outline and improve a display quality, therefore, a driving method whereby a subfield of a relatively long light emitting period is further divided into a plurality of subfields and they are distributed and arranged in the 1-field period has been proposed. According to the driving method, as a light emission pattern in the 1-field period is uniformed by increasing the number of subfields, a suppressing effect of the pseudo outline rises.

There is, however, a problem such that as the number of subfields increases, the number of bits of drive data that is formed in correspondence to each subfield has to be also increased in accordance with it and a scale of the apparatus increases with the increase in number of bits.

The invention is made to solve the problems and it is an object of the invention to provide a driving method of a plasma display panel, in which a scale of an apparatus can be reduced by suppressing the number of bits of drive data while maintaining an image display of a high quality in which a pseudo outline has been suppressed.

According to the invention, there is provided a driving method of a plasma display panel in which a display period of one field is divided into a plurality of subfields and a light emitting state in each of the subfields is set in accordance with each bit of pixel data, to perform a halftone display, wherein the light emitting state in a subfield of a relatively long light emitting period is also set in accordance with the bit of the pixel data which sets the light emitting state in a subfield of a relatively short light emitting period among the subfields.

BRIEF DESCRIPTION OF THE DRAWINGS

FIG. 3 is a diagram showing an example of a conversion table in a data converting circuit 3;

FIG. 4 is a diagram showing an example of a conversion table in the data converting circuit 3;

FIG. 6 is a diagram showing correspondence relations among pixel data D, each bit of conversion pixel data HD which is read out from a memory 4, and each subfield;

FIG. 7 is a diagram showing correspondence relations among the pixel data D, each bit of the conversion pixel data HD which is read out from the memory 4, and each subfield;

FIG. 9 is a diagram showing a light emitting pattern of each pixel data D;

FIG. 10 is a diagram showing a light emitting pattern of each pixel data D;

FIG. 12 is a diagram showing a correspondence relation between the conversion pixel data HD and each subfield when applying the light emission driving format shown in FIG. 11; and FIG. 13 is a diagram showing a correspondence relation between the conversion pixel data HD and each subfield when applying the light emission driving format shown in FIG. 11.

DETAILED DESCRIPTION OF THE PREFERRED EMBODIMENT

An embodiment of the invention will now be described hereinbelow with reference to the drawings.

Figure 2:
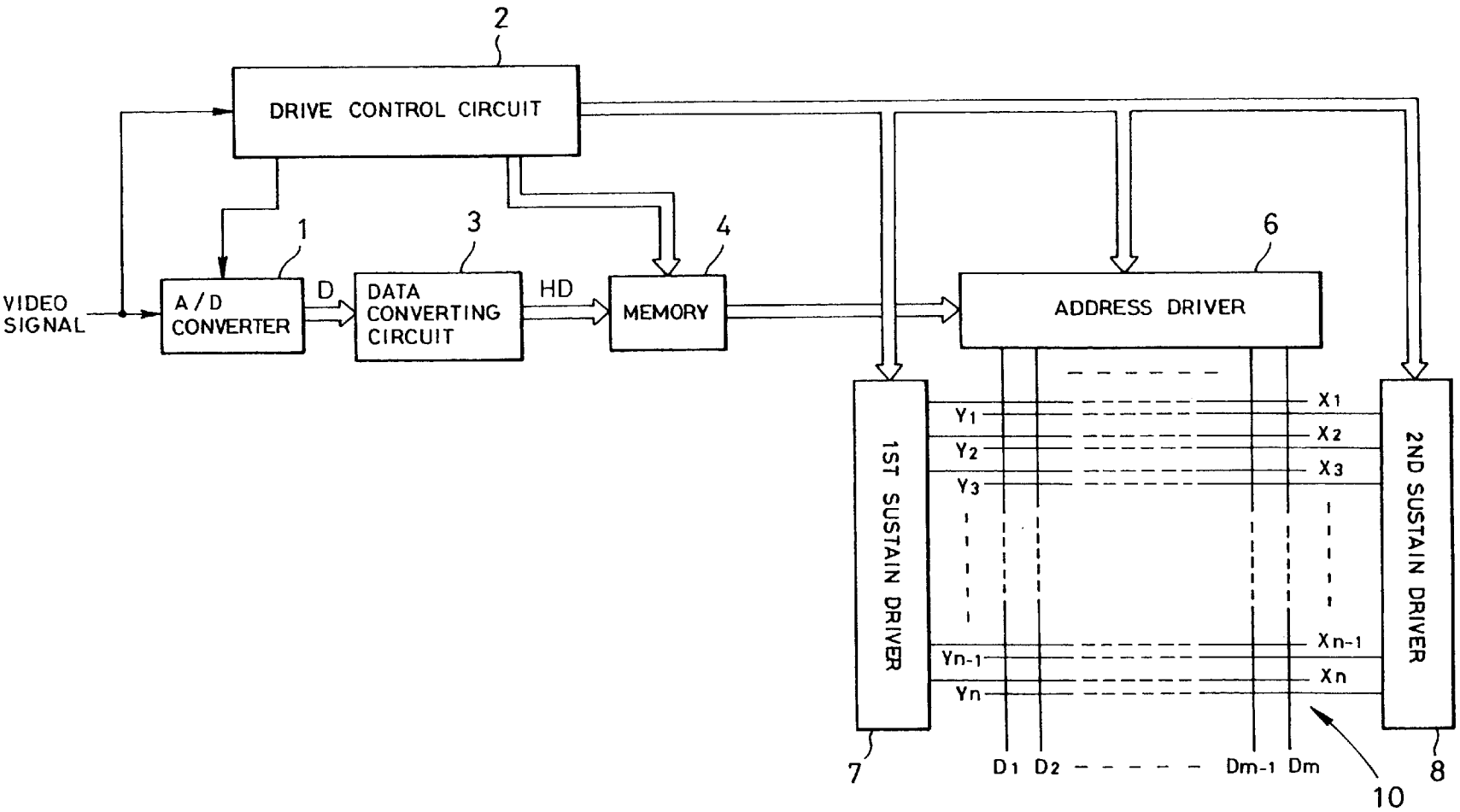
FIG. 2 is a diagram showing a schematic construction of a plasma display apparatus to drive a plasma display panel in accordance with a driving method of the invention.

FIG. 2 is a diagram showing a schematic construction of a plasma display apparatus having a driving apparatus to drive a plasma display panel (hereinafter, referred to as a "PDP") on the basis of a driving method according to the invention.

In FIG. 2, an A/D converter 1 samples an analog input video signal in response to a clock signal that is supplied from a drive control circuit 2, converts it into pixel data D of, for example, 6 bits every pixel, and supplies it to a data converting circuit 3.

The data converting circuit 3 converts the pixel data to conversion pixel data HD of 8 bits in accordance with conversion tables as shown in FIGS. 3 and 4 and supplies it to a memory 4. The conversion tables in FIGS. 3 and 4 shows examples of tables used when performing a halftone display of 64 gradations.

The conversion pixel data HD is sequentially written into the memory 4 in response to a write signal that is supplied from the drive control circuit 2.

When the writing of the pixel data as much as one picture plane (n rows, m columns) is finished by the writing operation, in the memory 4, each of conversion pixel data $HD_{11}$ to $HD_{nm}$ of one picture plane is divided every bit digit (the zero-th bit to the seventh bit), is sequentially read out in accordance with the following order, and is sequentially supplied every row to an address driver 6.

The 0th bit of each of the conversion pixel data $HD_{11}$ to $HD_{nm}$

The 1st bit of each of the conversion pixel data $HD_{11}$ to $HD_{nm}$

The 2nd bit of each of the conversion pixel data $HD_{11}$ to $HD_{nm}$

The 3rd bit of each of the conversion pixel data $HD_{11}$ to $HD_{nm}$

The 4th bit of each of the conversion pixel data $HD_{11}$ to $HD_{nm}$

The 5th bit of each of the conversion pixel data $HD_{11}$ to $HD_{nm}$

The 6th bit of each of the conversion pixel data $HD_{11}$ to $HD_{nm}$

The 7th bit of each of the conversion pixel data $HD_{11}$ to $HD_{nm}$

The 0th bit of each of the conversion pixel data $HD_{11}$ to $HD_{nm}$

The 1st bit of each of the conversion pixel data $HD_{11}$ to $HD_{nm}$

That is, in the memory 4, after completion of the reading of the zero-th to the seventh bits of each of the conversion pixel data $HD_{11}$ to $HD_{nm}$, the zero-th bit and the first bit are again read out and they are supplied to the address driver 6 within the 1-field period.

The address driver 6 converts each data bit in the conversion pixel data HD read out from the memory 4 into pixel data pulses $DP_1$ to $DP_m$ each having a voltage corresponding to the logic level every row and supplies them to column electrodes $D_1$ to $D_m$ of the PDP 10, respectively.

The drive control circuit 2 generates a clock signal to the A/D converter 1 and write/read signals to the memory 4 synchronously with horizontal and vertical sync signals in the supplied video signal. The drive control circuit 2 further generates a pixel data timing signal, a reset timing signal, a scan timing signal, and a sustain timing signal synchronously with the horizontal and vertical sync signals, respectively.

A first sustain driver 7 generates a reset pulse $RP_x$ to initialize a residual charge amount and a sustain pulse $IP_x$ to sustain the discharge light emitting state in response to the various timing signals supplied from the drive control circuit 2 and supplies them to row electrodes $X_1$ to $X_n$ of the PDP 10. A second sustain driver 8 generates a reset pulse $RP_y$ to initialize the residual charge amount, a scan pulse SP to write the pixel data, a priming pulse PP to allow the pixel data to be preferably written, and a sustain pulse $IP_y$ to sustain the discharge light emitting state in response to the various timing signals supplied from the drive control circuit 2, respectively, and supplies them to row electrodes $Y_1$ to $Y_n$ of the PDP 10.

In the PDP 10, the row electrode corresponding to one row of the picture plane is formed by a pair of row electrode X and row electrode Y. For example, a row electrode pair of the first row in the PDP 10 is constructed by the row electrodes $X_1$ and $Y_1$ and a row electrode pair of the nth row is constructed by the row electrodes $X_n$ and $Y_n$. In the PDP 10, one discharge cell is formed in an intersecting portion of the row electrode pair and each column electrode.

The driving operation of the PDP 10 which is embodied by the plasma display apparatus as shown in FIG. 2 will now be described.

Figure 5:
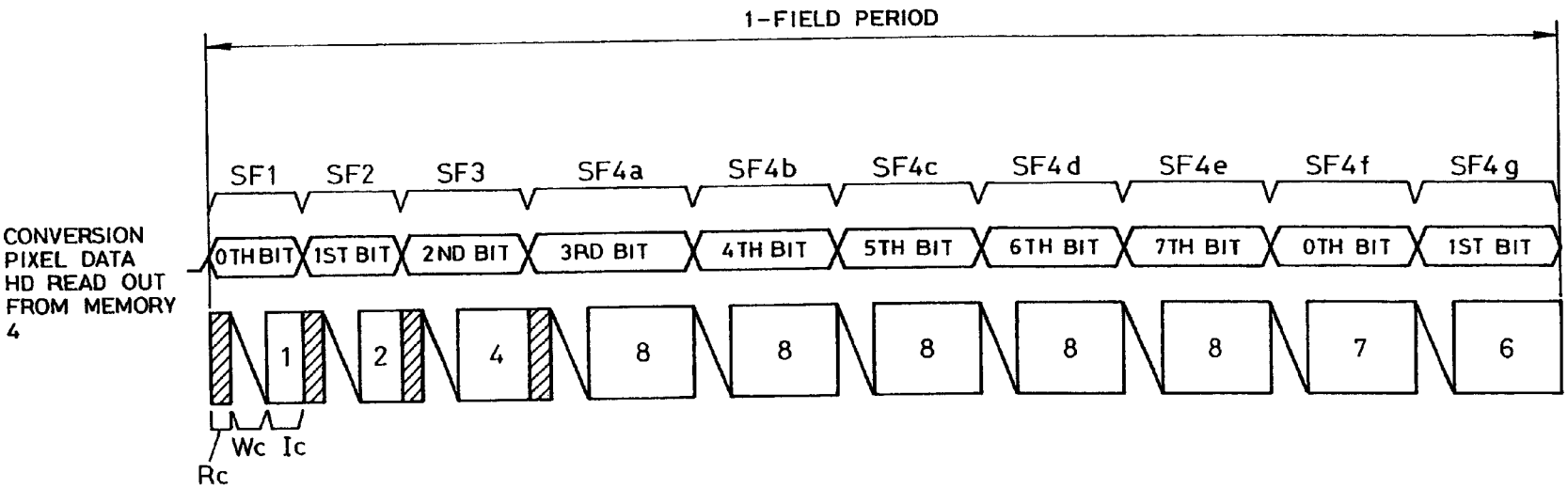
FIG. 5 is a diagram showing an example of a light emission driving format according to the invention.

FIG. 5 is a diagram showing a light emission driving format in the 1-field period which is embodied in the case where conversion tables which are used in the data converting circuit 3 are as shown in FIGS. 3 and 4.

In the light emission driving format shown in FIG. 5, the 1-field period is divided into ten divisional periods. The discharge light emission by the subfield SF1 is executed in the first divisional period. The discharge light emission by the subfield SF2 is executed in the next divisional period. The discharge light emission by the subfield SF3 is executed in the further next divisional period. In the remaining seven divisional periods after the subfield SF3, the discharge light emission by the subfields SF4*a* to SF4*g* is sequentially executed.

In each of the subfields SF1 to SF3 and SF4*a* to SF4*g*, the pixel data writing step Wc to set the light emission cell and the non-light emission cell by writing each data bit in the conversion pixel data HD read out from the memory 4 and the sustain light emitting step Ic to allow only the light emission cell to sustain the discharge light emitting state are executed as mentioned above.

In the pixel data writing step Wc that is executed in each subfield, as shown in FIG. 5, the following writing operations are executed.

SF1: Writing of the 0th bit in the conversion pixel data HD

SF2: Writing of the 1st bit in the conversion pixel data HD

SF3: Writing of the 2nd bit in the conversion pixel data HD

SF4*a*: Writing of the 3rd bit in the conversion pixel data HD

SF4*b*: Writing of the 4th bit in the conversion pixel data HD

SF4*c*: Writing of the 5th bit in the conversion pixel data HD

SF4*d*: Writing of the 6th bit in the conversion pixel data HD

SF4*e*: Writing of the 7th bit in the conversion pixel data HD

SF4*f*: Writing of the 0th bit in the conversion pixel data HD

SF4*g*: Writing of the 1st bit in the conversion pixel data HD

Figure 1:
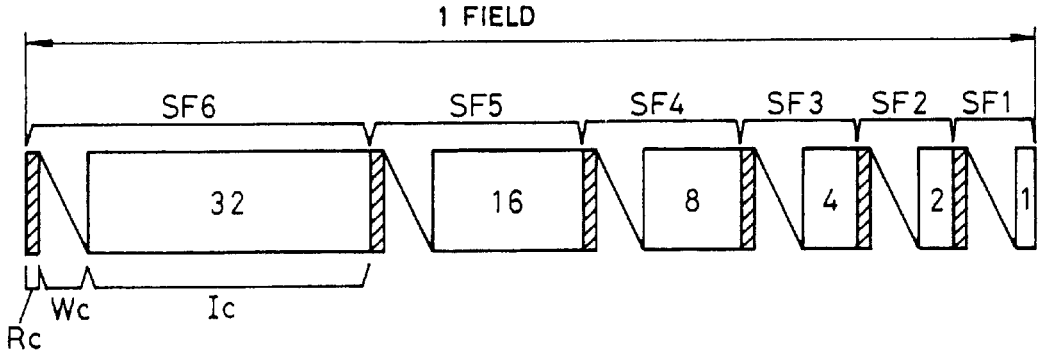
FIG. 1 is a diagram showing a conventional light emission driving format to embody a halftone display of 64 gradations.

FIGS. 6 and 7 are diagrams showing correspondence relations among all of the data patterns of the pixel data D of 6 bits obtained by the A/D converter 1 shown in FIG. 1, the bits (the 0th to 7th bits) of the conversion pixel data HD which is read out from the memory 4 in correspondence to those data patterns, and the subfields.

By the writing process in the pixel data writing step Wc, for example, the discharge cell in which the data bit at the logic level "0" has been written is discharge excited (erasure discharge) and the wall charges remaining in the discharge cell are extinguished. The discharge cell in which the data bit at the logic level "1" has been written is not excited to discharge and the wall charges remain. The discharge cell in which the wall charges have been extinguished becomes the non-light emission cell and the discharge cell in which the wall charges remain becomes the light emission cell.

In the sustain light emitting step Ic of each of the subfields SF1 to SF3 and SF4*a* to SF4*g*, the discharge light emission is sustained only for the discharge cell which was set to the light emission cell in the pixel data writing step Wc.

Now, assuming that the light emitting time in the subfield SF1 is equal to "1", the light emitting time by the sustain light emitting step Ic in each subfield is as follows.

SF1: 1

SF2: 2

SF3: 4

SF4*a*–SF4*e*: 8

SF4*f*: 7

SF4*g*: 6

Prior to the execution of the pixel data writing step Wc, the all-resetting step Rc to discharge excite (reset discharge) all of the discharge cells in a lump and form the wall charges in all of the discharge cells is executed. In this operation, as shown in hatched regions in FIG. 5, the all-resetting step Rc is executed only in the subfields SF1, SF2, SF3, and SF4*a*. That is, in the subfield series comprising the subfields SF4*a* to SF4*g*, the all-resetting step Rc is executed only in the subfield SF4*a* in the head portion.

FIGS. 8A to 8G are diagrams showing applying timings of various driving pulses which are actually supplied to the electrodes of the PDP 10 in the subfield series comprising the subfields SF4*a* to SF4*g*.

As shown in FIGS. 8C to 8F, first, the first sustain driver 7 and second sustain driver 8 simultaneously apply the reset pulses $RP_x$ and $RP_y$ to the row electrodes X and Y of the PDP 10, thereby reset discharging all of the discharge cells in the PDP 10. By the reset discharge, the wall charges are forcibly formed in all of the discharge cells in the PDP 10 (all-resetting step Rc shown in FIG. 8G).

Figures 8A, 8B, 8C, 8D, 8E, 8F, 8G:
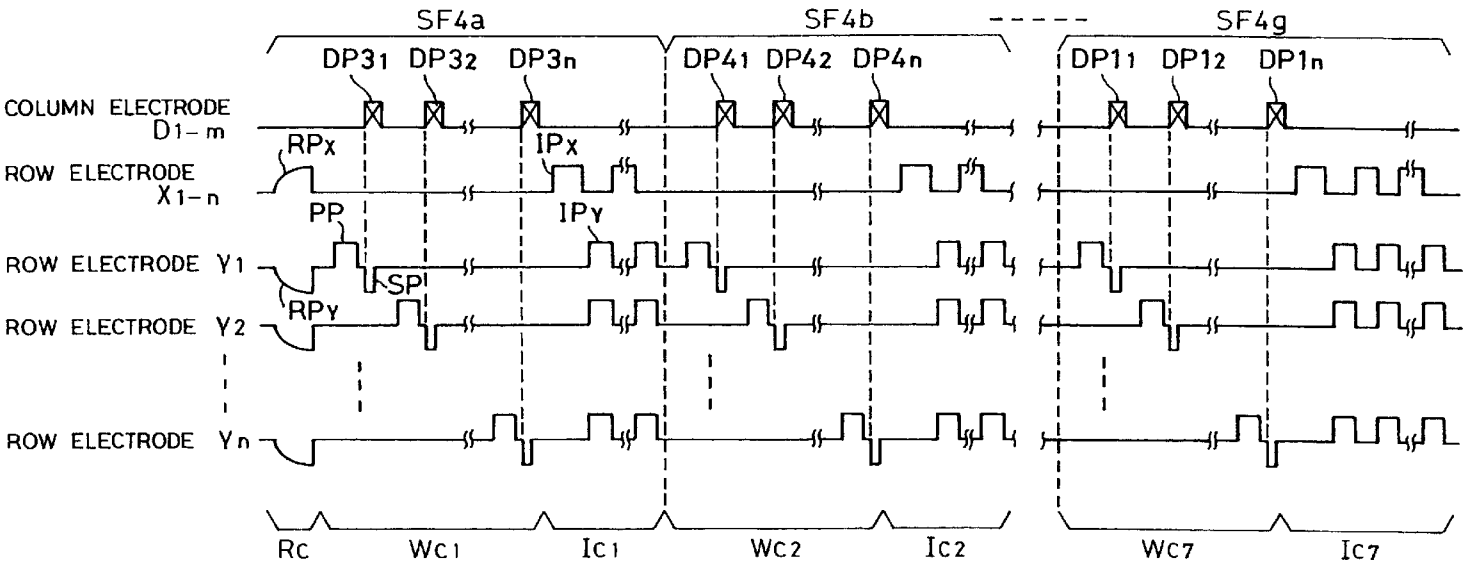
FIGS. 8A to 8G are diagrams showing examples of applying timings of various driving pulses which are supplied to a PDP 10 in subfields SF4*a* to SF4*g;*

Subsequently, the address driver 6 sequentially applies data pulses $DP3_1$ to $DP3_n$ corresponding to the rows to the column electrodes $D_1$ to $D_m$ as shown in FIG. 8B. At this time point, each of the data pulses $DP3_1$ to $DP3_n$ which are applied to the column electrodes $D_1$ to $D_m$ corresponds to the third bit in the conversion pixel data HD as shown in FIG. 3. The second sustain driver 8 sequentially applies the scan pulse SP to the row electrodes $Y_1$ to $Y_n$ at the same timings as the applying timings of the data pulses DP. In this operation, the discharge occurs only in the discharge cell in the intersecting portion of the "row" to which the scan pulse was applied and the "column" to which the pixel data pulse of a high voltage was applied and the wall charges remaining in this discharge cell are selectively erased. By the selective erasure, the light emission discharge cell in which the discharge light emission is performed in the sustain light emitting step as will be explained later and the non-light emission discharge cell in which the discharge light emission is not performed are set.

Just before each scan pulse SP is applied to each row electrode Y, the priming pulse PP of the positive polarity is sequentially applied to the row electrodes $Y_1$ to $Y_n$. By the priming discharge excited in response to the priming pulse PP applied, the charged particles which were reduced with the lapse of time although they had been formed in the all-resetting step Rc are again formed in the discharge space of the PDP 10. While the charged particles exist, the writing of the pixel data by applying the scan pulse SP is performed (pixel data writing step Wc1 in FIG. 8G).

Subsequently, the first sustain driver 7 and second sustain driver 8 alternately apply the sustain pulses $IP_x$ and $IP_y$ to the row electrodes X and Y. In this operation, the discharge cell in which the wall charges remain by the pixel data writing step Wc1, namely, the light emission discharge cell repeats the discharge light emission and maintains its light emitting state for a period of time during which the sustain pulses $IP_x$ and $IP_y$ are alternately applied (sustain light emitting step Ic1 in FIG. 8G).

By the subfield SF4*b* (shown in FIG. 8A) comprising the all-resetting step Rc, pixel data writing step Wc1, and sustain light emitting step Ic1 as mentioned above, the the discharge light emission corresponding to the third bit in the conversion pixel data HD is performed for the period of time of "8" as shown in FIG. 5. A series of operations comprising the all-resetting step Rc, pixel data writing step Wc1, and sustain light emitting step Ic1 is also similarly performed in each of the subfields SF1, SF2, and SF3 shown in FIG. 5.

When the subfield SF4*a* is finished, the address driver 6 subsequently sequentially applies data pulses $DP4_1$ to $DP4_n$ corresponding to the rows to the column electrodes $D_1$ to $D_m$. Each of the data pulses $DP4_1$ to $DP4_n$ which are applied to the column electrodes $D_1$ to $D_m$ at this time point corresponds to the fourth bit in the conversion pixel data HD as shown in FIG. 3. The second sustain driver 8 sequentially applies the scan pulse SP to the row electrodes $Y_1$ to $Y_n$ at the same timings as the applying timings of the data pulses DP. In this operation, a discharge occurs only in the discharge cell in the intersecting portion of the "row" to which the scan pulse SP was applied and the "column" to which the pixel data pulse of a high voltage was applied and the wall charges remaining in this discharge cell are selectively erased. By the selective erasure, the light emission discharge cell in which the discharge light emission can be performed in a sustain light emitting step Ic2, which will be explained later, and the non-light emission discharge cell in which the discharge light emission is not performed are derived. Just before each scan pulse SP is applied to each row electrode Y, the priming pulse PP of the positive polarity is sequentially applied to the row electrodes $Y_1$, to $Y_n$. By applying the priming pulse PP, the charged particles are again formed in the discharge space of the PDP 10. While the charged particles exist, therefore, the writing of the pixel data by applying the scan pulse SP is performed (pixel data writing step Wc2 in FIG. 8G).

Subsequently, the first sustain driver 7 and second sustain driver 8 alternately apply the sustain pulses $IP_x$ and $IP_y$ to the row electrodes X and Y. In this operation, the discharge cell in which the wall charges remain by the pixel data writing step Wc2, namely, the light emission discharge cell repeats the discharge light emission and maintains its light emitting state for a period of time during which the sustain pulses $IP_x$ and $IP_y$ are alternately applied (sustain light emitting step Ic2 in FIG. 8G).

By the subfield SF4*b* (shown in FIG. 8A) comprising the pixel data writing step Wc2 and sustain light emitting step Ic2, therefore, the discharge light emission corresponding to the fourth bit in the conversion pixel data HD is performed for the period of time of "8" as shown in FIG. 5.

After the subfield SF4*b*, the subfields SF4*c*, SF4*d*, and SF4*e* are sequentially executed by the operation similar to that in the subfield SF4*b*. By the subfields SF4*c*, SF4*d*, and SF4*e*, therefore, the discharge light emission corresponding to each of the fifth to seventh bits in the conversion pixel data HD is performed for the period of time of "8" as shown in FIG. 5.

After the subfield SF4*e*, the subfield SF4*f* is executed by the operation similar to that in the subfield SF4*e*. In the subfield SF4*f*, as shown in FIG. 5, the discharge light emission corresponding to the 0th bit in the conversion pixel data HD is performed for a period of time of "7". In this operation, the discharge light emission corresponding to the zero-th bit of the conversion pixel data HD has already been performed in the subfield SF1, the light emitting time is set to "7" longer than "1" in the subfield SF1.

After the subfield SF4*f*, the subfield SF4*g* (shown in FIG. 8A) is executed by the operation similar to that in the subfield SF4*f*. By the execution of the subfield SF4*g*, the discharge light emission corresponding to the first bit in the conversion pixel data HD is performed for a period of time of "6" as shown in FIG. 5. In this operation, the discharge light emission corresponding to the first bit of the conversion pixel data HD is the discharge light emission which has already been performed in the subfield SF2. However, the light emitting time is set to "6" longer than "2" in the subfield SF2.

As mentioned above, in the subfield series comprising the subfields SF4*a* to SF4*g*, the all-resetting step Rc in which the wall charges should be formed is performed only in the subfield SF4*a* in the head portion. The discharge cell in which the wall charges were extinguished in the pixel data writing step in any one of the subfields SF4*a* to SF4*g*, therefore, does not become a light emission discharge cell even if the conversion pixel data at the logic level "1" in which the light emission should be designated in the pixel data writing step of the subsequent subfields is supplied. Light emitting patterns which are formed on the basis of each data pattern of the conversion pixel data HD as shown in FIGS. 6 and 7, therefore, become as shown in FIGS. 9 and 10. In FIGS. 9 and 10, it is shown that the light emission occurs only in the subfields indicated by white circles. For example, when the pixel data D is [0,0,1,1,1,1] showing the luminance level "15", the conversion pixel data HD is set to [1,1,1,1,0,0,0,0] as shown in FIG. 3. The conversion pixel data that is read out from the memory 4 is set to [1,1,1,1, 0,0,0,0,1,1] as shown in FIG. 6. That is, in each of the subfields SF4*f* and SF4*g*, the conversion pixel data (the zero-th and first bits) at the logic level "1" in which the light emission should be designated is supplied. Since the fourth bit is at the logic level "0" in which the non-light emission is designated, however, the wall charges remaining in the discharge cell are extinguished at the execution stage of the subfield SF4*b*. As shown in FIG. 9, therefore, the light emission does not occur in the subsequent subfields SF4*c* to SF4*g*. Since the light emission occurs only in the subfields SF1, SF2, SF3, and SF4, the display luminance at the luminance level "15" is obtained by the sum of the light emitting times.

The light emitting operation occurs in the subfield SF4*f* in the case where at least all of the subfields SF1 and SF4*a* to SF4*e* enter the light emitting state as shown in FIG. 10. The light emitting operation occurs in the subfield SF4*g* in the case where at least all of the subfields SF1, SF2, and SF4*a* to SF4*e* enter the light emitting state as shown in FIG. 10.

As shown in FIG. 10, when the luminance level designated by the pixel data D exceeds "40", the display luminance that is actually displayed is slightly deviated from the luminance level designated by the pixel data D. A small deviation of the luminance in the high luminance portion exceeding "40" among 64 gradations, however, does not cause a visual problem.

According to the driving method, therefore, as shown in FIG. 5, even when the 1-field period is divided into ten subfields SF1 to SF3 and SF4*a* to SF4*g* and the driving is performed, the number of bits of the drive data (conversion pixel data HD) can be set to eight bits as shown in FIGS. 3 and 4. Further, since the number of times of the all-resetting step Rc which is executed for the 1-field period is equal to 4 smaller than the number (10) of subfields, a contrast at the time of the image display can be raised.

Although the above embodiment has been described with respect to the operation, as an example, when the supplied pixel data D consists of six bits, namely, when a halftone display of 64 gradations is performed, the number of gradations is not limited to 64. For example, the invention can be also similarly applied to a case of performing the halftone display of 256 gradations in accordance with the pixel data D of 8 bits.

Figure 11:
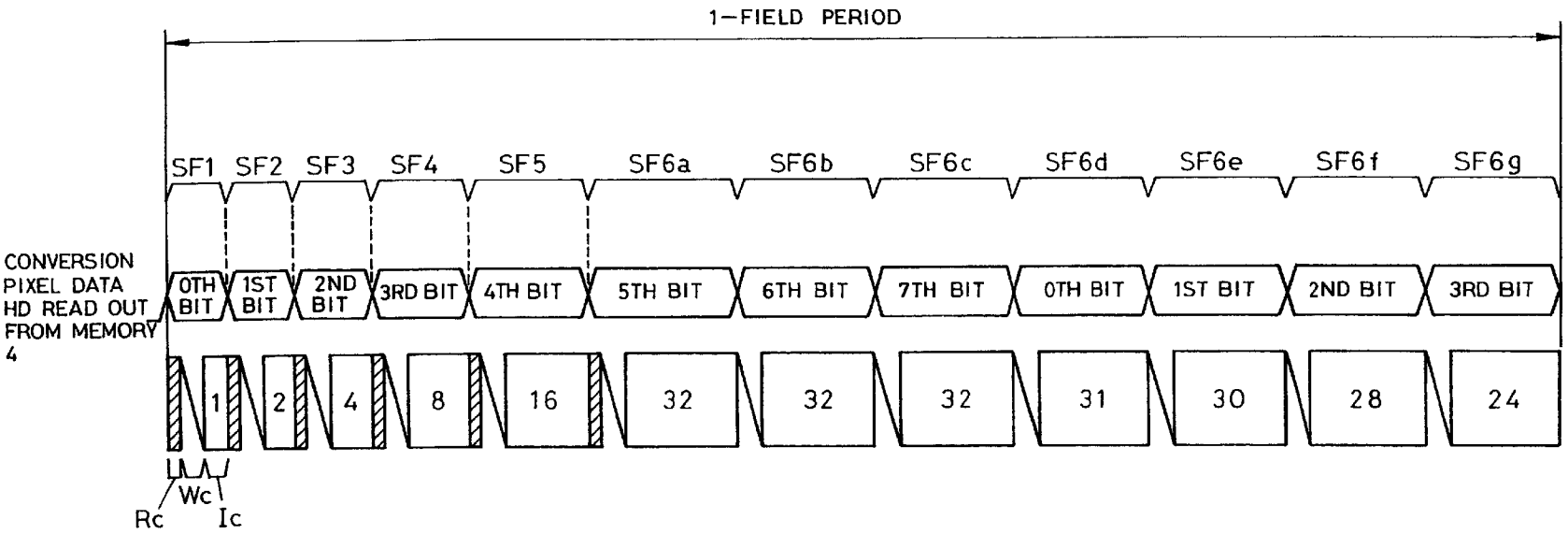
FIG. 11 is a diagram showing an example of a light emission driving format by which the PDP 10 is light emission driven at 256 gradations.

FIG. 11 is a diagram showing an example of a driving format in the case of driving the PDP 10 to emit light at 256 gradations. FIGS. 12 and 13 are diagrams showing correspondences among the 8-bit conversion pixel data HD (the 0th to 7th bits) converted in accordance with the 8-bit pixel data D and each subfield.

As shown in FIGS. 11 to 13, in the driving method, the light emitting period ratio of each subfield is set as follows.

SF1: 1

SF2: 2

SF3: 4

SF4: 8

SF5: 16

SF6*a*–SF6*c*: 32

SF6*d*: 31

SF6*e*: 30

SF6*f*: 28

SF6*g*: 24

The all-resetting step Rc (shown by a hatched portion) to allow all of the discharge cells to uniformly form the wall charges is executed in the head portion of each of the subfields SF1 to SF5. In this operation, the subfields SF6*a* to SF6*g* in which weights of the light emitting periods are almost equal are continuously executed and the all-resetting step Rc as shown in the hatched portion is performed only in the head subfield SF6*a*. Further, in the pixel data writing step Wc of each of the subfields SF6*d* to SF6*g*, the light emission discharge cell and the non-light emission discharge cell are set by again using the zero-th to third bits in the conversion pixel data HD.

According to the driving method, therefore, even when the 1-field period is divided into 12 subfields as shown in FIG. 11 and the driving is performed, the number of bits of the drive data (conversion pixel data HD) can be set to 8.

As shown in FIGS. 12 and 13, the display luminance almost corresponding to the supplied pixel data of 256 gradations is obtained.

According to the present invention, as described in detail, when the 1-field period is divided into a plurality of subfields and the light emission driving is performed, the drive data to perform the light emission in the subfield of the relatively short light emitting period is used as it is as drive data to perform the light emission in the subfield of the relatively long light emitting period.

With this driving method, therefore, since the number of bits of the drive data can be reduced to a number smaller than the number of subfields in the 1-field period, a reduction of the apparatus scale can be realized without deteriorating the display quality for a pseudo outline.

What is claimed is:

1. A driving method of a plasma display panel in which a display period of one field is divided into a plurality of subfields and a light emitting state in each of said subfields is set in accordance with each bit of pixel data, thereby performing a halftone display, wherein a light emitting state in a subfield of a light emitting period which is longer than a shorter light emitting period is set in accordance with a bit of said pixel data setting a light emitting state in the subfield of the shorter light emitting period among said subfields.

2. A driving method of a plasma display panel for driving the plasma display panel in which a discharge cell corresponding to one pixel is formed at each of intersection points of a plurality of row electrodes arranged every scanning line and a plurality of column electrodes arranged so as to intersect said row electrodes, comprising:

a step of dividing a display period of one field is divided into a plurality of subfields, and forming a subfield group in which subfields having long light emitting periods in each of said subfields are arranged consecutively;

an all-resetting step for performing a reset-discharging of all of the discharge cells at once, thereby forming wall charges; and a pixel data writing step of writing said pixel data by an erasure-discharge to selectively erase said wall charges formed in said discharge cells in accordance with a pixel data bit corresponding to each of said subfields, wherein, in said pixel data writing step, a writing in each of the subfields of a long light emitting period is also performed in accordance with a pixel data bit corresponding to a subfield of a light emitting period shorter than said longer light emitting period among said plurality of subfields.

3. A method according to claim 2, wherein said all-resetting step and said erasure discharge are performed only once in said subfield group, respectively.

4. A method according to claim 2, wherein said subfields of the long light emitting period are arranged at an end of said subfield group.

5. A method for driving a display, comprising:

(a) dividing a display period of one field into a plurality of subfields comprising at least a first subfield and a second subfield, wherein a first light emitting period of said first subfield is longer than a second light emitting period of said second subfield;

(b) setting a first light emitting state of said first subfield based on a first bit of pixel data; and (c) setting a second light emitting state of said second subfield based on said first bit of said pixel data.

6. The method as claimed in claim 5, wherein said plurality of subfields further comprises a third subfield and wherein said method further comprises:

(d) setting a third light emitting state of said third subfield based on a second bit of said pixel data which is different than said first bit.

* * * * *